US007696693B2

(12) United States Patent
Lim

(10) Patent No.: US 7,696,693 B2
(45) Date of Patent: Apr. 13, 2010

(54) EXTERNAL ELECTRODE FLUORESCENT LAMP FOR LIQUID CRYSTAL DISPLAYS AND A METHOD OF MAKING THE SAME

(75) Inventor: Dae-San Lim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 319 days.

(21) Appl. No.: 11/319,569

(22) Filed: Dec. 29, 2005

(65) Prior Publication Data

US 2006/0202603 A1 Sep. 14, 2006

(30) Foreign Application Priority Data

Mar. 14, 2005 (KR) ..... 10-2005-0020939

(51) Int. Cl.

| | |
|---|---|
| ***H01J 61/36*** | (2006.01) |
| ***H01J 9/18*** | (2006.01) |
| *G09F 13/08* | (2006.01) |
| *H01J 9/00* | (2006.01) |

(52) U.S. Cl. ..... 313/607; 313/234; 313/249; 313/291; 313/624; 313/491; 349/161

(58) Field of Classification Search ..... 313/600–607, 313/627–643, 567, 594, 234, 623–624; 362/69
See application file for complete search history.

(56) References Cited

U.S. PATENT DOCUMENTS

| | | | | |
|---|---|---|---|---|
| 5,965,988 | A * | 10/1999 | Vollkommer et al. | 315/246 |
| 6,507,151 | B1 * | 1/2003 | Kraus et al. | 313/631 |
| 6,515,433 | B1 * | 2/2003 | Ge et al. | 315/227 R |
| 6,603,248 | B1 * | 8/2003 | Trentelman | 313/234 |
| 2002/0021564 | A1 * | 2/2002 | Cho et al. | 362/97 |
| 2003/0222601 | A1 | 12/2003 | Yamamoto et al. | |
| 2003/0231512 | A1 * | 12/2003 | Bang et al. | 362/560 |
| 2004/0135484 | A1 * | 7/2004 | Lim | 313/234 |
| 2004/0178731 | A1 * | 9/2004 | Takeda et al. | 313/607 |
| 2004/0222743 | A1 * | 11/2004 | Takagi et al. | 313/634 |
| 2004/0232853 | A1 * | 11/2004 | Hur et al. | 315/291 |
| 2004/0263042 | A1 * | 12/2004 | Jung et al. | 313/234 |

FOREIGN PATENT DOCUMENTS

| | | |
|---|---|---|
| JP | 08-273863 | 10/1996 |
| JP | 2003-036703 | 2/2003 |
| KR | 2003-0080915 | 10/2003 |

* cited by examiner

*Primary Examiner*—Sikha Roy
*Assistant Examiner*—Tracie Green
(74) *Attorney, Agent, or Firm*—Morgan Lewis & Bockius LLP

(57) ABSTRACT

A fluorescent lamp includes a tube filled with a discharge gas and a fluorescent material, a first external electrode covering an outer edge of the tube, the first external electrode having a tetragonal cap-like shape, and a second external electrode on an outer surface of the tube, the second external electrode contacting the first external electrode.

7 Claims, 4 Drawing Sheets

EXTERNAL ELECTRODE FLUORESCENT LAMP FOR LIQUID CRYSTAL DISPLAYS AND A METHOD OF MAKING THE SAME

The present invention claims the benefit of Korean Patent Application No. 2005-0020939 filed in Korea on Mar. 14, 2005, which is hereby incorporated by reference.

BACKGROUND OF THE INVENTION

1. Field of the Invention

The present invention relates to a fluorescent lamp, and more particularly, to a fluorescent lamp for a backlight unit in a liquid crystal display (LCD) device and a method of fabricating the fluorescent lamp.

2. Discussion of the Related Art

With development of the information society, flat panel display (FPD) devices have been developed and widely utilized as substitutes for cathode ray tube (CRT) devices because the FPD devices have light weight, thin profile, and low power consumption characteristics. Generally, display devices are classified into emissive display devices and non-emissive display devices according to their ability for self-emission. The emissive display devices display images by taking advantage of their ability to self-emit light, whereas the non-emissive display devices require light sources since they do not emit light by themselves. For example, plasma display panel (PDP) devices, field emission display (FED) devices, and electroluminescent display (ELD) devices belong to the emissive display devices. The LCD devices, which are usually categorized as non-emissive display devices, are widely utilized in notebook and desktop computers because of their high resolution, capability of displaying color images, and high quality image display.

The LCD device includes an LCD module that is provided with an LCD panel for displaying images and a backlight unit for supplying light to the LCD panel. The LCD panel includes two substrates facing and spaced apart from each other, and a liquid crystal layer interposed therebetween. The liquid crystal layer includes liquid crystal molecules that have a dielectric constant and refractive index anisotropic characteristics because of their long, thin shapes. In addition, two electrodes for generating an electric field are formed on the two substrates, respectively. Accordingly, an orientation alignment of the liquid crystal molecules can be controlled by supplying a voltage to the two electric field generating electrodes, thereby changing transmittance of the LCD panel based on polarization properties of the liquid crystal molecules. However, the LCD panel belongs to a non-emissive-type display device, and needs an additional light source. Thus, the backlight unit is disposed under the LCD panel as the light source. In particular, the LCD panel displays images using light produced by the backlight unit.

In general, the backlight units are either edge-types or direct-types, according to the disposition of the light sources. As display areas of the LCD devices become increasingly large, the direct-type backlight units, including a plurality of light sources, are usually utilized to provide high brightness.

A fluorescent lamp, used as the light source of the backlight unit, is a cold cathode fluorescent lamp (CCFL). The CCFL includes a glass tube and an external electrode that extends from an end portion of the glass tube. However, with respect to a large size LCD panel, using the CCFL as an the edge-type backlight unit fails to provide adequate brightness because it fails to evenly distribute light to the large size LCD panel. On the other hand, the CCFL can be used as a direct-type connected as a parallel arrangement; however the CCFL is not driven using just one inverter. Thus, the number of the CCFLs restricts proper brightness of the LCD panel. Therefore, a reflector having a predetermined configuration is necessary, and a distance between a diffusion plate and the CCFL should be set long enough to obtain a uniform brightness, thereby causing an increase in the thickness of the LCD panel.

Accordingly, with respect to a large size LCD panel with high brightness and high efficiency, an external electrode fluorescent lamp (EEFL) is utilized to provide a long life and light weight for the LCD panel. The EEFL may be a belt type, a cap type or an expanded type. The expanded type EEFL includes a glass tube that has both end portions swelled out.

FIG. 1 is a schematic view illustrating a cold cathode fluorescent lamp (CCFL) according to the related art. FIG. 2 is a schematic view illustrating an external electrode fluorescent lamp (EEFL) according to the related art.

As shown in FIG. 1, a CCFL 5 includes a tube 1 filled with a discharge gas and a fluorescent material, an internal anode electrode 3*a* and an internal cathode electrode 3*b* in both inner edges of the tube 1, respectively. On the other hand, as shown in FIG. 2, an EEFL 15 includes a tube 10, an external anode electrode 13*a* and an external cathode electrode 13*b* that cover both outer edges of the tube 10, respectively.

The CCFL 5 has a disadvantage in that if the CCFL 5 is turned on frequently, its lifetime may be reduced due to damage to the internal anode electrode 3*a* and the internal cathode electrode 3*b* exposed mercury (Hg) molecules. In addition, when the CCFL 5 is applied to the edge-type backlight unit, although the CCFL 5 itself has high brightness, brightness of the LCD panel utilizing the CCFL 5 is low. For this reason, the edge-type CCFL is undesirable for use in an LCD panel. Similarly, when the CCFL 5 is applied to the direct-type backlight, multiple CCFLs 5 are arranged in a row and cannot be driven by one inverter.

The EEFL 15 of FIG. 2 has higher brightness, higher efficiency, longer lifetime, and a slimmer profile in comparison with the CCFL 5 of FIG. 1. However, the external anode electrode 13*a* and the external cathode electrode 13*b* of the EEFL 15 should have a predetermined length so as to maintain a minimum energy to excite electrons. This results in difficulty obtaining a desired bezel portion.

Recently, the lamps of the EEFL 15 have not been connected in a row so that each lamp is connected to each inverter. Thus, a light intensity of the lamp may be independently controlled, but the total size of the LCD device is increased. As a result, it is difficult to provide an LCD device with light weight and a thin profile.

SUMMARY OF THE INVENTION

Accordingly, the present invention is directed to a fluorescent lamp and a method of fabricating the same that substantially obviate one or more of the problems due to limitations and disadvantages of the related art.

An object of the present invention is to provide a fluorescent lamp and a method of fabricating the same that is capable of increasing an emitting efficiency.

Another object of the present invention is to provide a fluorescent lamp and a method of fabricating the same that is capable of extending the lifetime of electrodes in the fluorescent lamp.

Another object of the present invention is to provide a fluorescent lamp and a method of fabricating the same that is capable of obtaining a desired bezel portion.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a fluorescent lamp includes a tube filled with a discharge gas and a fluorescent material, a first external electrode covering an outer edge of the tube, the first external electrode having a tetragonal cap-like shape, and a second external electrode on an outer surface of the tube, the second external electrode contacting the first external electrode.

In another aspect, a fluorescent lamp includes a tube filled with a discharge gas and a fluorescent material, the tube having a U-like shape, and a first external electrode covering an outer edge of the tube.

In another aspect, a method of fabricating a fluorescent lamp includes filling a tube with a discharge gas and a fluorescent material, forming a first external electrode covering an outer edge of the tube, the first external electrode having a tetragonal cap-like shape, and forming a second external electrode on an outer surface of the tube, the second external electrode contacting the first external electrode.

In another aspect, a method of fabricating a fluorescent lamp includes filling a tube with a discharge gas and a fluorescent material, the tube having a U-like shape, and forming a first external electrode covering an outer edge of the tube It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
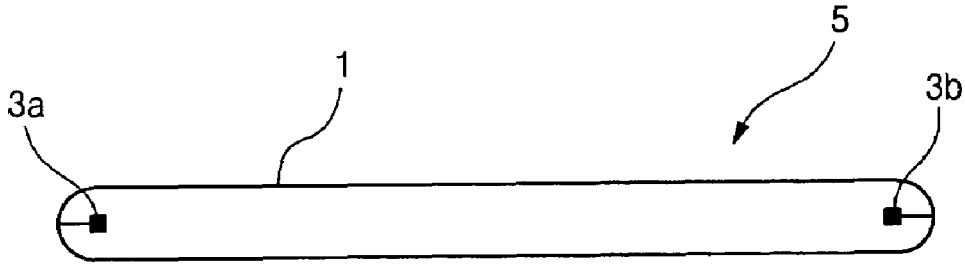
FIG. 1 (related art)
FIG. 1 is a schematic view illustrating a cold cathode fluorescent lamp (CCFL) according to the related art.
Figure 2:
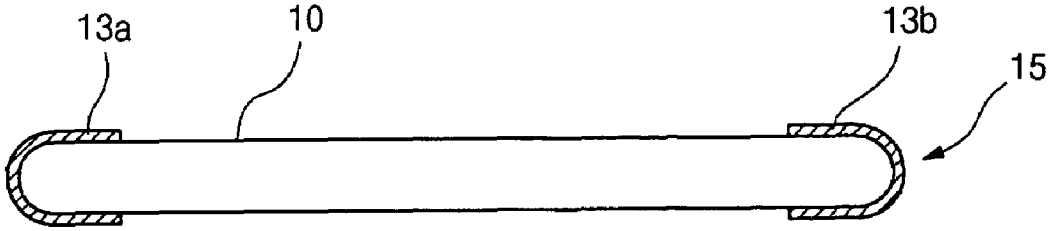
FIG. 2 (related art)
FIG. 2 is a schematic view illustrating an external electrode fluorescent lamp (EEFL) according to the related art.
Figure 3A:
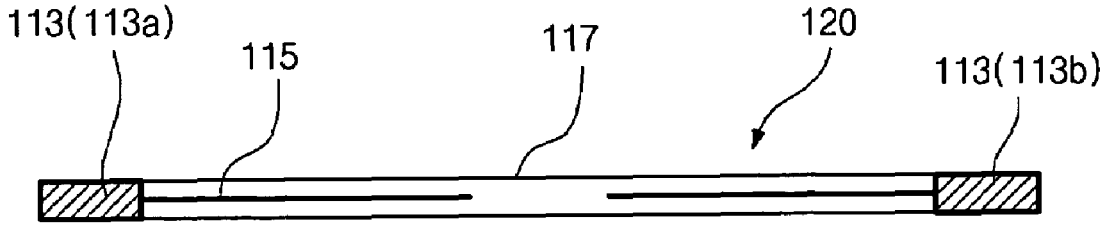
FIG. 3A is a schematic side view illustrating an external electrode fluorescent lamp (EEFL) according to one exemplary embodiment of the present invention.
Figure 3B:
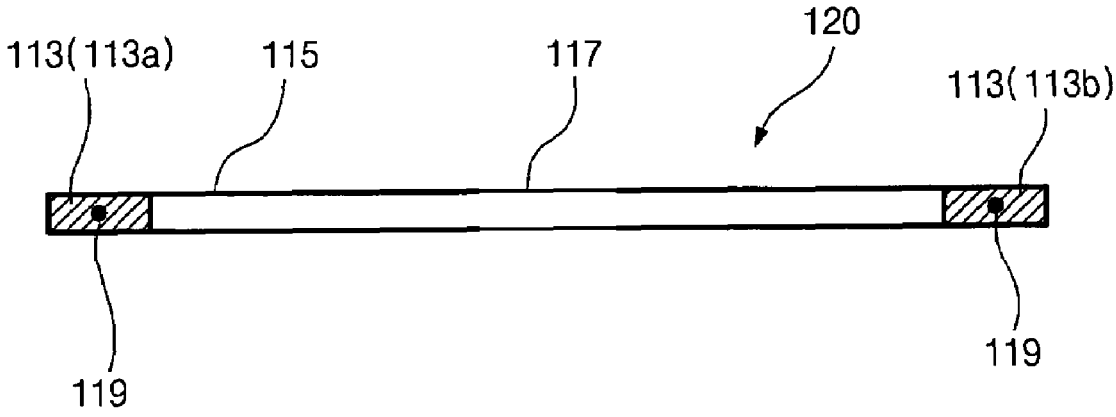
FIG. 3B is a front view illustrating an external electrode fluorescent lamp (EEFL) according to one exemplary embodiment of the present invention.

FIGS. 3A and 3B are schematic views illustrating an external electrode fluorescent lamp (EEFL) according to one exemplary embodiment of the present invention. FIG. 3A is a side view and FIG. 3B is a front view.

As shown in FIGS. 3A and 3B, an EEFL 120 includes a tube 117 filled with a discharge gas and a fluorescent material, a first external electrode 113 covering an outer edge of the tube 117, and a second external electrode 115 on an outer surface of the tube 117. More specifically, the first external electrode 113 has a tetragonal cap-like shape, and the second external electrode 115 contacts the first external electrode 113. For example, the first external electrode 113 includes a first external anode electrode 113*a* and a first external cathode electrode 113*b* disposed on the outer edges of the tube 117, respectively.

Moreover, as shown in FIG. 3B, a point 119 is marked on a front surface of the first external electrode 113 to guide the front side of the first external electrode 113. The second external electrode 115 may be disposed on a side portion of the tube 117 of a non-emitting region (not shown) by reference to the point 119. Thus, the second external electrode 115 can be easily formed in the non-emitting region (not shown). More specifically, in comparison with the related art, this exemplary embodiment utilizing the second external electrode 115 in the EEFL 120 provides a higher emitting efficiency and smaller size of the first external electrode 113, thereby obtaining a satisfactory bezel margin region. In addition, the design feature of the first external electrode 113 can improve product yield depending on each work condition.

However, when the CCFL is utilized in the direct type backlight unit, a plurality of lamps and a respective plurality of inverters are necessary, thereby increasing the total size of the LCD using the CCFL device. Accordingly, in another exemplary embodiment according to the present invention, an EEFL includes a U-like shape to reduce the number of the lamps and inverters, as well as to reduce the manufacturing costs.

Figure 4:
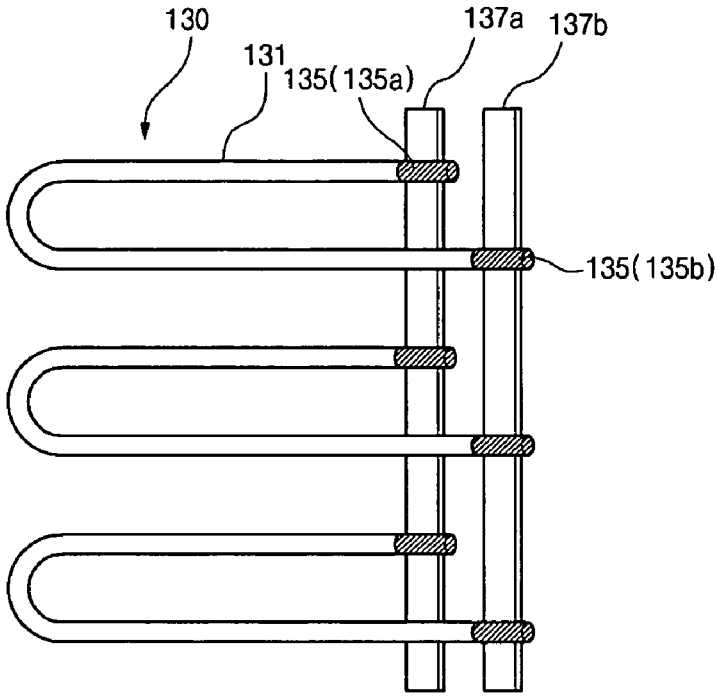
FIG. 4 is a schematic view illustrating a U-shaped EEFL according to another exemplary embodiment of the present invention.

FIG. 4 is a schematic view illustrating a U-shaped EEFL according to another exemplary embodiment of the present invention. As shown in FIG. 4, a U-shaped EEFL 130 includes a tube 131 filled with a discharge gas and a fluorescent material, a first external electrode 135 including a first external anode electrode 135*a* and a first external cathode electrode 135*b*, and first and second lamp flips 137*a* and 137*b* applying positive and negative voltages to the first external anode electrode 135*a* and the first external cathode electrode 135*b*, respectively.

In this exemplary embodiment, the tube 131 has a U-like shape. The first external electrode 135 having a cap-like shape covers outer edges of the tube 131. For example, the first external anode electrode 135*a* and the first external cathode electrode 135*b* are disposed on the outer edges of the tube 131 to arrange in a row. In addition, the first and second lamp flips 137*a* and 137*b* are arranged to contact the first external anode electrode 135*a* and the first external cathode electrode 135*b*, respectively. It is noted that each of the first external anode electrode 135*a* and the first external cathode electrode 135*b* is spaced apart from an opposite one of the first lamp flip 137*a* and the second lamp flip 137*b*. The first external electrode 135 may be selected from a group including at least silver (Ag), aluminum (Al), copper (Cu) and the like.

Forming the first external electrode 135, may include at least one of covering a metallic material on the tube 131, attaching a metallic tape, dipping an outer bending portion of the tube 131 into a metal solution and the like. Further, forming the first external anode electrode 135*a* and the first external cathode electrode 135*b* may include bending a straight tube at a predetermined position or forming the first external electrode 135 on a desired position of the tube 131, so that the first external anode electrode 135*a* and the first external cathode electrode 135*b* have different positions from each other by the first and the second lamp flips 137*a* and 137*b*.

The U-shaped EEFL 130 according to the exemplary embodiment can extend its lifetime without causing any damage to the first external electrode 135. In particular, it has an effect of using two straight lamps by one. Accordingly, when the U-shaped EEFL 130 is applied to the direct type backlight unit, the number of inverters and the number of lamps can be effectively reduced.

Figure 5:
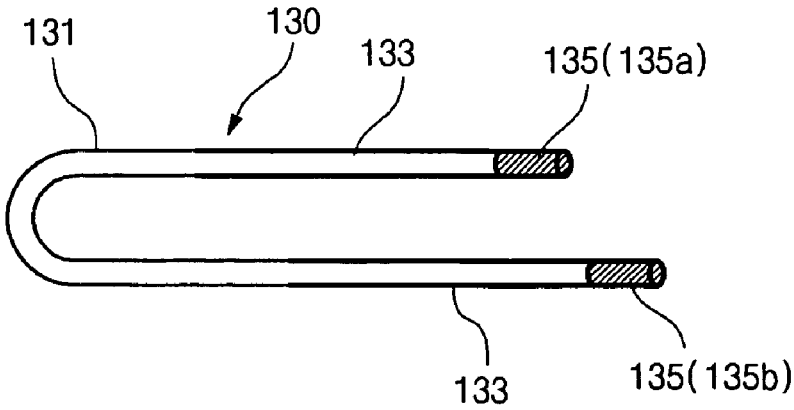
FIG. 5 is a schematic cross-sectional view illustrating an EEFL further including a second external electrode having a line-like shape with respect to the U-shaped EEFL of FIG. 4 according to another exemplary embodiment of the present invention.

FIG. 5 is a schematic cross-sectional view illustrating an EEFL further including second external electrodes having line-like shapes with respect to the U-shaped EEFL of FIG. 4 according to another exemplary embodiment of the present invention. As shown in FIG. 5, an EEFL 130 includes a U-shaped tube 131 filled with a discharge gas and a fluorescent material, and a first external electrode 135. The first external electrode 135 includes a first external anode electrode 135*a* and a first external cathode electrode 135*b* that have cap-like shapes and cover outer edges of the tube 131. Moreover, the EEFL 130 includes second external electrodes 133 contacting both of the first external anode electrode 135*a* and the first external cathode electrode 135*b* along a lengthwise direction of the tube 131. In this exemplary embodiment, the second external electrodes 133 are line-shaped and disposed in a side portion of the tube 131, so that the second external electrodes 133 do not occupy any emitting region of the EEFL 130. Herein, the line-shaped second external electrodes 133 may each be a straight line-shape, a curved line-shape, or the like. The length of the second external electrodes 133 is not limited within a range for maintaining a minimum energy capable of exciting electrons. Moreover, when a predetermined distance is set between the second external electrodes 133 that are connected to the different external electrodes 135*a* and 135*b*, overcharge due to collision between the second external electrodes 133 can be prevented.

As explained above, forming the first external electrode 135 may include steps of covering a metallic material on the tube 131, attaching a metallic tape, dipping the outer bending portion of the tube 131 into a metal solution, and the like. Similarly, forming the second external electrode 133 may include attaching a metallic tape with a straight type or dipping the EEFL into a metal solution, wherein the EEFL is covered by a tape, except for a region for forming the second external electrode 133. The tape should be removed from the EEFL after the process is finished. Moreover, in this exemplary embodiment, the size of the first external electrode 135 is reduced by extending the second external electrodes 133 therefrom, thereby obtaining a satisfactory bezel portion.

A distance between external electrodes 135*a* and 135*b* is closed by adding the line-shaped second external electrodes 133, thereby increasing electricity between the external anode electrode 135*a* and the external cathode electrode 135*b*. Moreover, brightness in a center portion of the fluorescent lamp is also increased by extending the second external electrodes 133 from the first external electrode 135. In addition, plasma ions are centered on the first external electrode 135, wherein the plasma ions can be distributed by extending the second external electrodes 133 from the first external electrode 135, thereby increasing the emitting efficiency of the EEFL 130.

Figure 6:
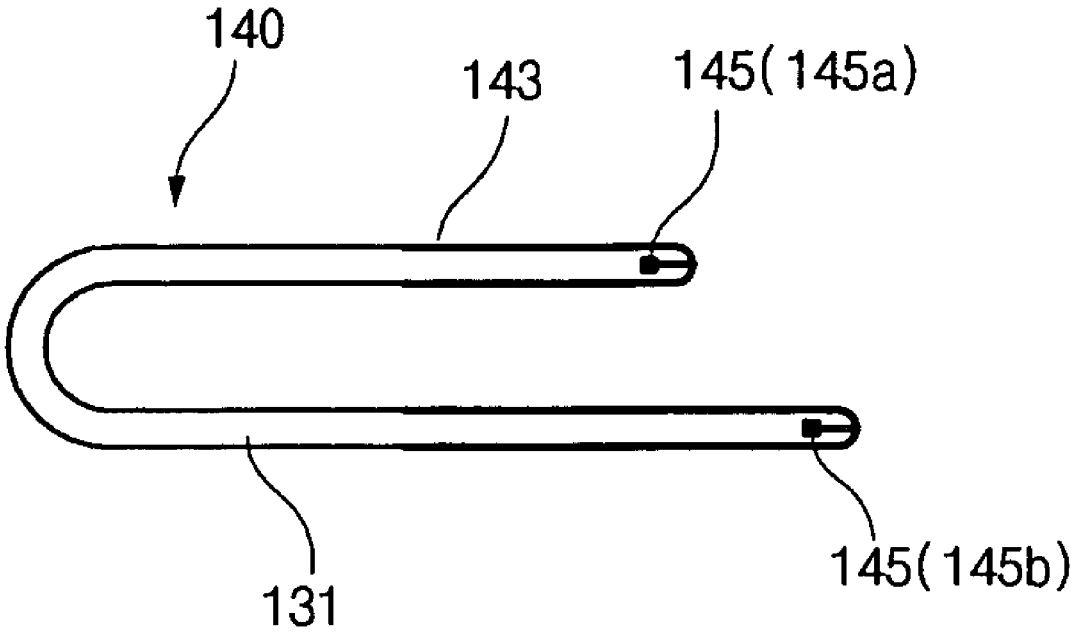
FIG. 6 is a schematic view illustrating a U-shaped cold cathode fluorescent lamp (CCFL) having an external electrode of a line-like shape according to another exemplary embodiment of the present invention.

FIG. 6 is a schematic view illustrating a U-shaped cold cathode fluorescent lamp (CCFL) having a line-shaped external electrode according to another exemplary embodiment of the present invention. As shown in FIG. 6, a U-shaped CCFL 140 includes a U-shaped tube 131 filled with a discharge gas and a fluorescent material, and an internal electrode 145 disposed in an inner edge of the tube 131. The internal electrode 145 includes an internal anode electrode 145*a* and an internal cathode electrode 145*b*.

The U-shaped CCFL 140 further includes an external electrode 143 disposed on an outer edge of the tube 131. The external electrode 143 has a line-like shape. More specifically, the external electrode 143 is formed in a non-emitting region (not shown) in a periphery region of the tube 131. The internal electrode 145 and the external electrode 143 are connected to each other as an alternating power-supply. In the CCFL 140 of this exemplary embodiment, the external electrode 143 is simultaneously formed with the internal electrode 145, so that a size that the discharge gas is charged with electricity can be widened, thereby increasing brightness of the CCFL 140.

The fluorescent lamp according to the exemplary embodiments of the present invention has advantages of improving the emitting efficiency and extending the lifetime of the electrodes. Moreover, it is possible to obtain a bezel portion having an enough margin and to improve work efficiency as well as product yield.

Although not shown, a method of fabricating a fluorescent lamp according to the present invention includes filling a tube with a discharge gas and a fluorescent material, forming a first external electrode covering an outer edge of the tube, forming the first external electrode having a tetragonal cap-like shape, and forming a second external electrode on an outer surface of the tube, the second external electrode contacting the first external electrode.

Another method of fabricating a fluorescent lamp includes filling a tube with a discharge gas and a fluorescent material, the tube having a U-like shape, and forming a first external electrode covering an outer edge of the tube.

The method includes forming a second external electrode contacting the first external electrode, wherein the first external electrode has a cap-like shape and the second external electrode has a line-like shape. The method includes forming an internal electrode in an inner edge of the tube, wherein the first external electrode has a line-like shape.

It will be apparent to those skilled in the art that various modifications and variations can be made in the fluorescent lamp and method of fabricating the same of the present invention without departing from the spirit or scope of the invention. Thus, it is intended that the present invention covers the modifications and variations of this invention provided they come within the scope of the appended claims and their equivalents.

What is claimed is:

1. A fluorescent lamp, comprising:

a tube filled with a discharge gas and a fluorescent material;

a first external electrode covering two outer edges of the tube, the first external electrode having a tetragonal cap-like shape;

a point marked on a front surface of the first external electrode; and a second external electrode directly formed on an outer surface of the tube, the second external electrode contacting the first external electrode, wherein the second external electrode is extended from the first external electrode and wherein the second external electrode is arranged along a lengthwise direction of the tube.

2. The lamp according to claim 1, wherein the second external electrode is shaped like a line.

3. The lamp according to claim 2, wherein the second external electrode is shaped like one of a straight line and a curved line.

4. The lamp according to claim 1, wherein the first external electrode and the second external electrode each include at least one of silver (Ag), aluminum (Al), and copper (Cu).

5. The lamp according to claim 1, wherein the first external electrode includes an anode and a cathode, the anode and the cathode being disposed on the two outer edges of the tube, respectively.

6. A method of fabricating a fluorescent lamp, comprising:

filling a tube with a discharge gas and a fluorescent material;

forming a first external electrode covering two outer edges of the tube, the first external electrode having a tetragonal cap-like shape;

marking a point on a front surface of the first external electrode; and directly forming a second external electrode on an outer surface of the tube, the second external electrode contacting the first external electrode, wherein the second external electrode is extended from the first external electrode and wherein the second external electrode is arranged along a lengthwise direction of the tube.

7. The method according to claim 6, wherein the second external electrode is formed on a non-emitting region of the outer surface of the tube.

* * * * *